United States Patent [19]

Awofolu

[11] 4,163,539

[45] Aug. 7, 1979

[54] READING TABLE

[76] Inventor: Duke L. Awofolu, 2600 Campcreek Pkwy #9-D, College Park, Ga. 30337

[21] Appl. No.: 887,667

[22] Filed: Mar. 17, 1978

[51] Int. Cl.[2] ..... A47B 97/04

[52] U.S. Cl. ..... 248/452; 248/457

[58] Field of Search ..... 248/130, 133, 137, 141, 248/371, 382, 445, 451, 452, 453, 454, 457

[56] References Cited

U.S. PATENT DOCUMENTS

| | | | |
|---|---|---|---|
| 1,691,191 | 11/1928 | Henderson | 248/454 |
| 2,423,048 | 6/1947 | Poch | 248/453 X |
| 2,570,439 | 10/1951 | Forca | 248/452 |

FOREIGN PATENT DOCUMENTS

| | | | |
|---|---|---|---|
| 512252 | 12/1930 | Fed. Rep. of Germany | 248/452 |
| 2509770 | 9/1975 | Fed. Rep. of Germany | 248/454 |
| 407879 | 12/1944 | Italy | 248/452 |

*Primary Examiner*—William H. Schultz

*Attorney, Agent, or Firm*—Robert D. Farkas

[57] ABSTRACT

A reading rable utilizes a pair of curved leg members to which is affixed a pair of upstanding posts. The posts are provided with an elongated notch having a plurality of circularly shaped openings therein. A flat sheet is utilized having a pair of outwardly extending shafts disposed residing in selected openings in the upright post. A locking nut-like apparatus is threadingly engaged with outwardly extending shafts so as to position the sheet at preferential angular locations relative to the longitudinal axis of the upstanding posts. The sheet is provided with a pair of adjustable arm mechanisms which are selectively positioned at locations along an upper marginal edge of the sheet and locked thereto by a telescopingly locking device utilizing a locking screw therefor. The adjustable arm mechanisms are provided with a pair of racks threadingly engaged with adjusting gears which dispose the racks along lines perpendicular to the plane of the sheet. Each rack is provided with a book holding arm extending perpendicularly from the longitudinal axis of the rack. In use, a book is rested upon the sheet and an upstanding bar affixed to the sheet having the pages thereof secured by the arm clampingly engaging the opened pages of the book.

7 Claims, 4 Drawing Figures

READING TABLE

BACKGROUND OF THE INVENTION

1. THE FIELD OF THE INVENTION

This invention relates to book holding devices and more particularly to that class of devices which independently engage each page of the opened book on a supporting surface which may be adjusted angularly from a supporting surface and at various heights thereabove.

2. DESCRIPTION OF THE PRIOR ART

The prior art abounds with book holding devices. U.S. Pat. No. 2,741,869 issued Apr. 17, 1956 to E. Aibel teaches a reading stand having a pair of legs disposed to finding a inverted V. A sheet, having a general U-shaped section, is pivotably secured to one of each of the pair of legs defining the stand. In use, a book is inserted in between the legs of the U-shaped sheet which may be positioned at any desired angle over a supporting surface adapted to provided horizontal support for user of apparatus. The Aibel apparatus suffers the deficiency of forcing the user to remove the books from the confine of the U-shaped sheet each time the pages are required to be turned.

U.S. Pat. No. 2,579,740 issued on Dec. 25, 1951 to V. D. Hiemenz discloses a four legged support for a bar which may be pivotably located so as to form a convertable reading stand. Attached to the bar is a sheet which may be positioned at any desirous angular location relative to the supporting surface upon which the legs rest. A T-shaped member is pivotably secured to the sheet and is adapted for compressing the open pages of a book between the cross member of the T-shaped element and the sheet upon which the spine of the book rests. The Hiemenz apparatus suffers a deficiency of providing a device whose height is not readily adjustable and which forces the user thereof to remove the T-shaped member from engagement with the opened pages before allowing the pages of the book to be turned.

SUMMARY OF THE INVENTION

A primary object of the present invention is to provide a book table which may be positioned at any angular location relative to the supporting surface adapted to provide vertical support therefor.

Another object of the present invention is to provide a book table support which may be angularly adjusted relative to the plane of the supporting surface.

Still another object of the present invention is to provide a book holding table whose book holding arms may be spaced apart any distance, thereby facilitating the use of the apparatus with books of various sizes.

Yet another object of the present invention is to provide a book holding device that may be easily loosened so as to accommodate convenient book page turning.

Another object of the present invention is to provide a book table that can be adapted for use with books of any thickness.

Heretofore, book holding devices provided convenience to the user by supporting a book in an open position so as to free the hands of the user during the reading operation. Such devices suffer deficiencies of one type or another which minimize the usefulness of the device when considering that books are available in various sizes and various thicknesses. Furthermore, it is highly desirable to utilize a book holding apparatus at any angle or any height over the surface designed to support it. The present invention contemplates such deficiencies and in its conception provides an apparatus which is suited for use with a wide variety of book construction and sizes conveniently positioning the book at any location that is desired while facilitating fastening the pages of the book so as to permit a simple page turning operation by the user.

These objects as well as other objects of the present invention will become more readily apparent after reading the following description of the accompanying drawings.

DESCRIPTION OF THE PREFERRED EMBODIMENT

Figure 1:
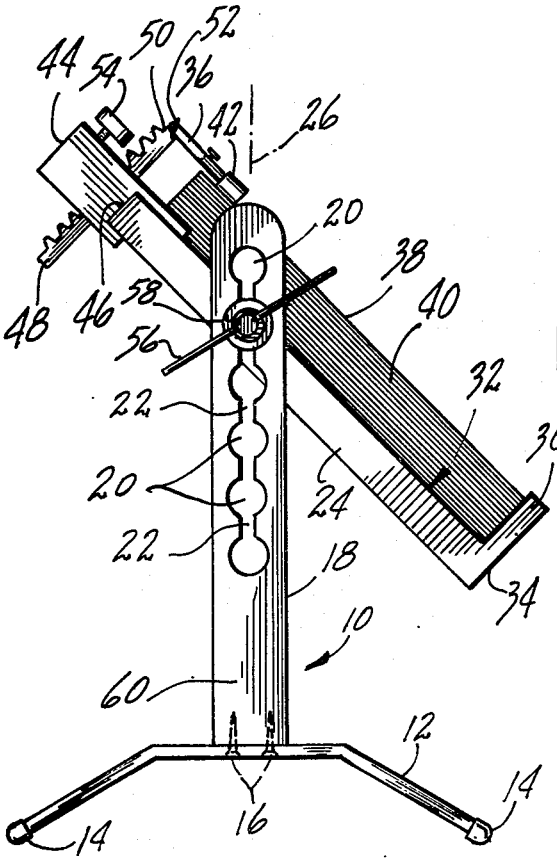
FIG. 1 is a side elevation view of the present invention.

The structure and method of fabrication of the present invention is applicable to an elongated flat sheet having a bar fixedly secured thereto extending outwardly from a forward lateral surface thereof. The bar is located adjacent a marginal edge of the sheet. The sheet is provided with a pair of rods extending outwardly from opposed marginal edges of the sheet so as to be coaxially aligned and having threads there upon. The rods are fitted with a pair of threaded nuts which are adapted to threadingly engage the thread of the rod. Each nut is provided with a rod-like handle extending radially outwardly with the threaded opening thereof. A stand is utilized, having a rod-like support member defining a substantially curved shape having rubber-like tips at the free end thereof. Each of the rod-like members of which there are a pair, are provided with a pair of upstanding posts. The posts are fixedly secured to the rod-like like members utilizing a pair of screws therefor. Each of the posts are provided with a plurality of connected circular openings extending along a line running parallel to the longitudinal axis of the posts. Each opening is configured to receive the heavy shaft extending outwardly from the sheet. The nut members are adapted to grasp the outermost surfaces of the post in a clamping relationship thereby positioning the sheet at any preferred angular relationship relative to the longitudinal axis of the upstand post. A washer may be utilized interposed between the adjacent marginal edge of the sheet to the post. The sheet is provided with a pair of book holding arm mechanisms utilizing a bar having a rectangular notch therein. The notch is configured to reside about the uppermost marginal edge of the sheet. Incased within the bar is a helical gear member adapted to engage a rack having helical teeth on the surface thereof. The rack is mounted in sliding engagement within an opening in the bar such that the longitudinal axis of the rack is positioned vertically to the lateral surfaces of the sheet when the bar is clamped to the sheet. The end of the rack disposed adjacent to the uppermost lateral surface of the sheet has a book holding arm clampingly and pivotably engaged therewith. A wing nut and bolt arrangement is utilized for this purpose. A rubber-like tip is fitted to the free end of the book holding arm. The helical gear is journaled to the bar utilizing a shaft therefor having one end thereof extending outwardly from the bar to which an adjustment knob is secured. Upon rotation of the adjustment knob the rack moves along the line perpendicular to the uppermost lateral surface of the sheet thereby causing the book holding arm to move closer or further from such surface. Each bar mechanism is secured to one another utilizing a pair of telescoping elements having one end of each secured to each bar. A threaded bolt having a narrow knob affixed to one end thereof is threadingly engaged to the outermost telescoping element so that the innermost telescoping element may be clamped thereto when the knob is turned, thereby causing each book holding bar and arm to be displaced at any adjustable position desired along the uppermost edge of the sheet.

In use, a book is inserted in the uppermost lateral surface of the sheet having the edges of the book residing on the bar affixed to the sheet. The book holding arm, and more specifically the rubber-like tip affixed thereto is adapted to grasp the open pages of the book. By adjusting the knob on each bar each book holding arm is caused to more toward the surface of the opened pages adjacent thereto, thereby accommodating various thicknesses of books and facilitating a turning operation for the open pages of the book.

Now referring to the figures, and more particularly to the embodiment illustrated in FIG. 1 showing the present invention 10 having a curved rod 12 to which is affixed rubber-like ends 14 at the free ends thereof. Screws 16 are utilized to affix an upstanding vertically located post 18 thereto. Circular opening 20 are located along the length of post 18 and are interconnected by screws 22. Sheet 24 is shown residing at an angle relative to the longitudinal axis of post 18 depicted by dotted lines 26. Sheet 24 is provided with bar 30 which extends outwardly from uppermost lateral surface 32 of sheet 24 located adjacent marginal edge 34 thereof. A bookholding arm 36 is shown residing upon surface 38 of book 40 by having rubber-like tip 42 engage page 38 in compressive fictional contact. Bar 44 is shown mounted to marginal edge 46 of sheet 24 and is provided having rack 48 extending passing through bar 44. End 50 of rack 48 is shown passing through end 52 of arm 36. Knob 54 is shown secured to bar 44. Handle 56 is shown extending outwardly from nut 58 residing on exterior surface 60 of post 18.

Figure 2:
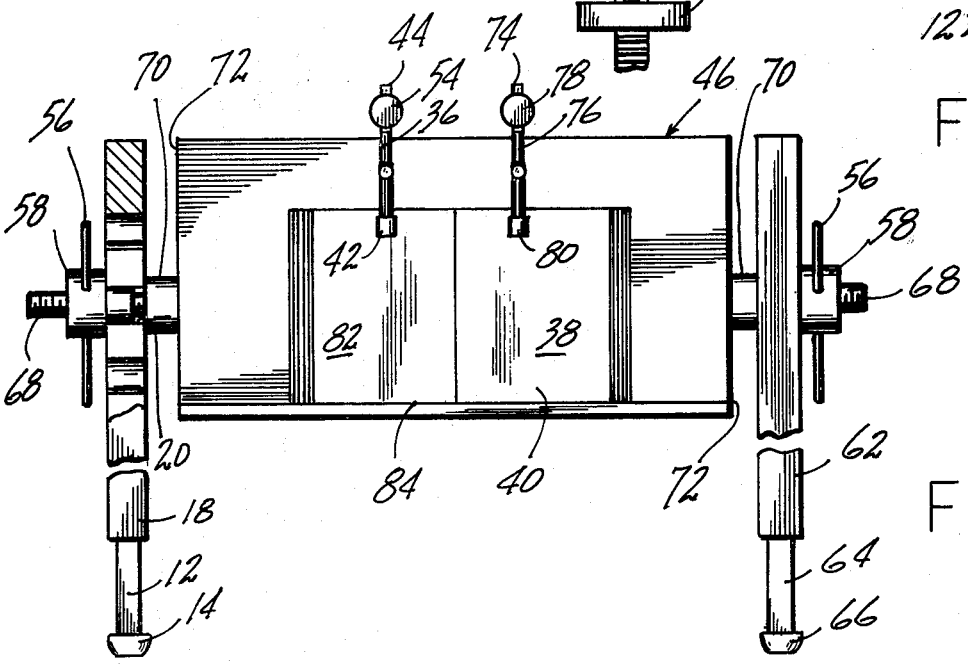
FIG. 2 is a front elevation view of the present invention.

FIG. 2 illustrates post 18 and companion post 62 shown in spaced apart parallel relationship being supported by rod 12 and rod 64 respectively. Rod 64 is provided with rubber-like end 66, similar in function and in location to rubber-like end 14. Sheet 24 is shown attached to threaded rod 68, each extending outwardly and coaxially aligned to each other from sheet 24. Rods 68 have openings 20 in upstanding post 18. Washers 70 separate marginal edges 72 of sheet 24 from upstandpost 18 and 62. Nuts 58 are threadingly engaged with threaded rod 68 and are shown having rod-like handles 56 emerging radially outwardly therefrom. The uppermost marginal edge 46 of sheet 24 is shown having bars 44 and 74 disposed thereon in spaced apart relationship. Arms 36 and 76 are shown affixed to bars 44 and 74 respectively. Knobs 54 and 78 are shown extending upwardly from bars 44 and 74. Rubber-like ends 42 and 80 are shown engaging pages 38 and 82 of book 40 whose lower most edge 84 is shown resting on bar 30.

Figure 3:
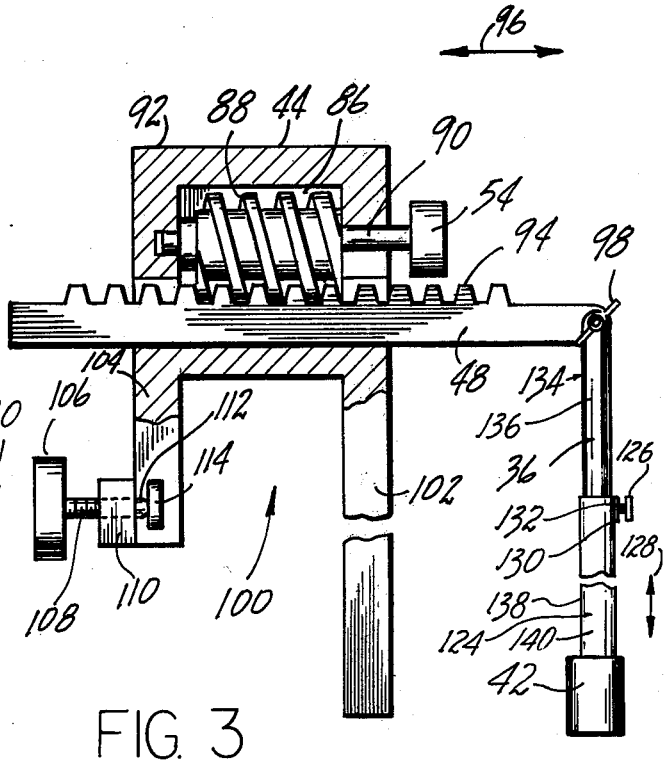
FIG. 3 is a side elevation view of a portion of the present invention.

FIG. 3 illustrates bar 44 having cavity 86 therein. Helical gear 88 is shown carried by shaft 90 journaled to bar 84. Knob 54 is shown extending outwardly from bar 44 and is fixedly secured to shaft 90. Teeth 92 of gear 88 engages teeth 94 of rack 48. Rotation of knob 54 causes rack 48 to move in the direction of arrows 96. Arm 36 is shown pivotably secured to rack 48 utilizing thumb screw 98 therefor. Cavity 100 is formed within bar 44 as configured to reside about uppermost marginal edge 46 of sheet 24, as shown in FIG. 1 and 2. Leg 102, defining cavity 100 and leg 104 are dispoed in parallel relationship and adapted to reside on opposed lateral surfaces of sheet 24, shown in FIGS. 1 and 2. Knob 106 is carried by threaded rod 108 which passes through block 110 utilizing a threaded hole therein. End 112 of threaded rod 108 engages rectangularly shaped opening 114 in leg 104.

Figure 4:
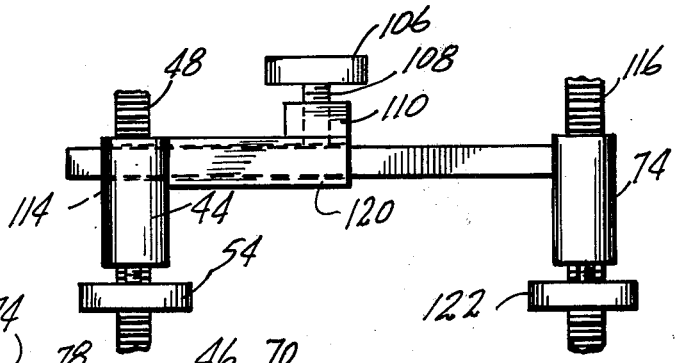
FIG. 4 is a front elevation view of a portion of the present invention.

FIG. 4 illustrates bar 44 and bar 74 shown in spaced apart parrallel relationship, carrying racks 48 and rack 116. Rectangularly shaped bar 118 extends outwardly from bar 74 at right angles to rack 116. Rectangularly shaped bar 118 engages rectangular opening 114 in bar 44. Bar 44 also carries rectangular tubing element 120 which telescopingly engages rectangular bar 118 therein. Lock 110 is affixed to tubing 120 and carries threaded rod 108 to which is affixed knob 106. Thus, locks 44 and 74 may be spaced apart at any desired distance when knob 106 is turned so as to loosen threaded rod 108 from clamping engagement with rectangular bar 118. When desired, knob 106 may be rotated so as to tighten threaded rod 108 against an exterior surface of rectangular bar 118 thereby locking together bars 44 and 74 at a selected distance. Knob 54 and knob 122 is shown extending outwardly from bars 44 and 74 respectively.

One of the advantages of the present invention is to provide a book table which may be positioned at any angular location relative to the supporting surface adapted to provide vertical support therefor Another advantage of the present invention is to provide a book table support which may be angularly adjusted relative to the plane of the supporting surface.

Still another advantage of the present invention is to provide a book holding table whose book holding arms may be spaced apart any distance, thereby facilitating the use of the apparatus with books of various sizes.

Yet another advantage of the present invention is to provide a book holding device that may be easily loosened so as to accommodate convenient book page turning.

Thus, there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows:

1. A book holding table comprising a sheet, a pair of posts, said pair of posts each having a plurality of connected spaced apart openings disposed in spaced apart relationship therein, a pair of threaded rods, said pair of threaded rods being aligned in coaxial relationship extending outwardly and fixedly secured to opposed marginal edges of said sheet, each of said pair of threaded rods residing in one of said plurality of openings, a pair of nuts, each of said pair of nuts threadingly engaged adjacent the free end of each of said threaded rods, a pair of curved rods, said each of said pair of curved rods fixedly secured to one end of said each of said pair of posts, a pair of bars, said pair of bars each having a cavity therein, said cavity being configured to reside about a marginal edge of said sheet, a rack, said rack passing through an opening in one of said bars, a gear, said gear journaled to said bar, said gear having the teeth thereof coupled to the teeth of said rack, an arm, said arm pivotably lockingly engaged to one end of said rack, said arm being disposed in selective locations outwardly from an exterior surface of said sheet, a single bar, said single bar being disposed fixably secured to an uppermost lateral surface of said sheet and adjacent another marginal edge thereof, said another marginal edge being located opposed to said marginal edge of said sheet.

2. The apparatus as claimed in claim 1 further comprising said pair of nuts having a rod-like member extending radially outwardly from a threaded opening therein.

3. The apparatus as claimed in claim 1 further comprising a pair of washers, said pair of washers being disposed residing on said pair of threaded rods at a location intermediate said pair of opposed marginal edges and said pair of posts.

4. The apparatus as claimed in claim 1 further comprising means to adjustably position said pair of bars at selected locations along the length of said marginal edge of said sheet.

5. The apparatus as claimed in claim 1 further comprising one end of each of said arms having a rubber-like tip affixed thereto.

6. The apparatus as claimed in claim 1 further comprising a knob, said knob fixedly secured to said gear, said knob carried by a shaft, said shaft being fixedly secured to said gear, said shaft being journaled to said bar, said knob being located outwardly of said bar.

7. The apparatus as claimed in claim 1 wherein said gear has helical teeth located on the exterior surface of said gear.

* * * * *